US006436599B1

(12) United States Patent
Matsuoka et al.

(10) Patent No.: US 6,436,599 B1
(45) Date of Patent: Aug. 20, 2002

(54) TONER, METHOD OF PRODUCING TONER, AND IMAGE FORMING METHOD USING TONER

(75) Inventors: Hirotaka Matsuoka; Jong Won Lee; Isamu Suzuki, all of Minami-Ashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/902,666

(22) Filed: Jul. 12, 2001

Related U.S. Application Data

(62) Division of application No. 09/121,301, filed on Jul. 23, 1998, now abandoned.

(30) Foreign Application Priority Data

Jul. 28, 1997 (JP) ..... 9-201621

(51) Int. Cl.[7] ..... G03G 9/08

(52) U.S. Cl. ..... 430/137.19; 430/108.8; 430/111.4; 430/137.14

(58) Field of Search ..... 430/109, 110, 430/111, 109.4, 109.3, 111.4, 110.3, 108.8, 137.19, 137.14, 137.17, 137.2

(56) References Cited

U.S. PATENT DOCUMENTS

| | | | | |
|---|---|---|---|---|
| 2,297,691 | A | 10/1942 | Carlson | |
| 3,666,363 | A | 5/1972 | Tanaka et al. | |
| 5,578,409 | A | 11/1996 | Kotaki et al. | 430/109.4 |
| 5,605,778 | A | 2/1997 | Onuma et al. | 430/45 |
| 5,753,399 | A | 5/1998 | Hayase et al. | 430/109.3 |
| 5,756,244 | A | 5/1998 | Omatsu et al. | 430/45 |
| 5,759,732 | A | 6/1998 | Nakamura et al. | 430/110.1 |
| 5,797,070 | A | 8/1998 | Waki et al. | 399/149 |
| 5,935,751 | A | 8/1999 | Matsuoka et al. | 430/137.17 |
| 5,948,584 | A | 9/1999 | Hashimoto et al. | 430/124 |

FOREIGN PATENT DOCUMENTS

| | | |
|---|---|---|
| JP | B-36-10231 | 7/1936 |
| JP | B-42-23910 | 11/1942 |
| JP | A-50-120632 | 9/1975 |
| JP | A-52-3304 | 1/1977 |
| JP | A-52-3305 | 1/1977 |
| JP | A-56-87051 | 7/1981 |
| JP | A-57-52574 | 3/1982 |
| JP | A-61-138529 | 6/1986 |
| JP | A-63-25664 | 2/1988 |
| JP | A-63-188158 | 8/1988 |
| JP | A-5-127422 | 5/1993 |
| JP | A-7-152202 | 6/1995 |
| JP | A-7-168395 | 7/1995 |
| JP | A-7-271099 | 10/1995 |
| JP | A-8-179556 | 7/1996 |
| JP | A-8-220808 | 8/1996 |

OTHER PUBLICATIONS

Neufeldt, V. et al., ed. *Webster's New World Dictionary*, Third College Edition, Simon & Schuster, Inc. (NY) (1988), p. 250.

*Primary Examiner*—Janis L. Dote
(74) *Attorney, Agent, or Firm*—Oliff & Berridge, PLC

(57) ABSTRACT

The present invention provides a toner comprising a binder resin, a colorant, and a releasing agent wherein the releasing agent has an endothermic starting temperature of 40° C. or more and a melting point of 120° C. or less which are measured using a differential scanning calorimeter, the binder resin contains a linear resin and a non-linear resin, the content of the releasing agent existing at the surface of toner particles is 0 to 30% by weight, and the shape factor MLS2 of the toner particles is from 100 to 130. Preferably a mixture of a linear Polyester and a non linear polyester is used as the binder resin. Preferably the weight average molecular weight of the linear polyester is $2.0\times10^3$ to $5.0\times10^4$. The toner of the present invention has excellent developing characteristics and transfer characteristics, and superior offset resistance even in an oil-less fixing system. When recording a color image using the toner of the present invention, the resulting image has high quality and the OHP transmittancy is improved.

2 Claims, 3 Drawing Sheets

TONER, METHOD OF PRODUCING TONER, AND IMAGE FORMING METHOD USING TONER

This is a Division of application Ser. No. 09/121,301 filed Jul. 23, 1998, abandoned. The entire disclosure of the prior application(s) is hereby incorporated by reference herein in its entirety.

BACKGROUND OF THE INVENTION

1. Field of the Invention

The present invention relates to a toner used in an electrostatic photographic process or the like, a method of producing the toner, and an image forming method using the toner.

2. Description of the Related Art

Various methods have been known as an electrophotographic method as described in U.S. Pat. No. 2,297,691, Japanese Patent Application Publication (JP-B) No.42-23910 (U.S. Pat. No. 3,666,363), and the like. The electrophotographic method generally comprises fundamental steps including an exposure step of forming a latent image by exposure means on a photorecepter using a photoelectroconductive material, a step of developing the latent image using a toner (forming a toner image), a step of transferring the toner image to a recording material such as paper, a step of fixing the transferred toner image by means of heating and/or pressure or solvent vapor, and a step of removing a residual toner from the photorecepter.

In recent years, there have been a demand for inexpensive and miniaturized copiers and printers using an electrophotographic method. In order to design such a copier or a printer, it is important to fix a toner image at low consumption electronic power in a simple manner. As a means of fixing the toner image to paper at present, a method comprising a step of melting and fixing the toner image using a heat-roll is generally used.

In copiers and printers used for forming a monochromatic image, a system (hereinafter called "oilless fixing") in which no oil is supplied to a heat roll is generally adopted. In copiers and the like used for forming a color image, a means of supplying oil is still essential for the purpose of preventing an offset to a heat roll. This is an obstacle to achievements of copiers used for forming a color image with a miniaturized and inexpensive system.

Particularly, it is necessary to melt under heat each color toner layer sufficiently in case of a system of forming multi-color images with vivid color by a subtractive color mixing method using cyan, yellow, and magenta toners. It is therefore necessary to fix color images by use of the heat roll at a higher temperature than in case of the monochromatic copiers and the like. As a consequence, an offset phenomenon tends to occur, which necessitates the supply of oil to the heat roll.

When a resin of which fusion curve is sharp is used as a binder resin for the toner in the case of forming a multi-color image, an image surface can be smooth, which is desirable. As such a resin, a polyester is frequently used which exhibits sufficient plasticity even if its molecular weight is lowered. However, if a polyester resin which has low internal cohesion is used for a color toner, the toner can be peeled off from the heat roll with difficulty after it is melted. It is therefore difficult to fix toner images using the oilless fixing method.

In order to solve such a problem, the methods are proposed in which a releasing agent, e.g. wax, is added to the toner to help the toner to peel off the roll as described in, for example, Japanese Patent Application Publication (JP-B) Nos. 52-3304, 52-3305, Japanese Patent Application Laid-Open (JP-A) Nos. 57-52574, 61-138259, 56-87051, 63-188158, and the like. When the releasing agent is internally added, the separation of the toner from the heat roll is improved. However, the other characteristics of the toner are sometimes worse by internally adding the releasing agent.

For example, when the toner is produced by a conventional melt mixing/pulverizing method, an addition of the releasing agent in an amount as small as 1 to 3% by weight impairs the fluidity and thermal cohesiveness of toner powder. This is caused by a large leakage of the releasing agent together with a pigment to the surface of the toner which is a crushed breaking surface. Furthermore, in process steps, toner particles collides with each other in a crasher or classifier, or with the wall of the apparatus to cause frictional heat, by which the releasing agent which exists on the surface of the toner is partially melted and spread. There is the case that the toner further covers the surface of the toner. On the surface of a melt mixed/pulverized toner to which 1 to 10% by weight of a releasing agent is added, a releasing agent generally exists in a proportion as high as 30 to 50% by weight. As a consequence, a blocking phenomenon (a condition in which the toner is coagulated into a solid) is caused while using the toner and further the releasing agent contaminates the surfaces of a photorecepter and carrier thereby inducing variations in the developing characteristics.

Furthermore, the addition of the releasing agent to the toner causes an increase in the adhesion of the toner to an intermediate transfermember and the transfer efficiency of the toner hence tends to be lowered. As a result, there is the case that the image is disordered when a color image which requires multiple transfer steps is formed.

In addition, a sufficient shear is not sometimes applied to the toner containing the releasing agent and the dispersibility of the releasing agent is often deteriorated, resulting in formation of a dull or dark image, imparting a problem when especially an OHP color image with high transmittance is formed.

In order to solve such a problem of the toner produced by the melt mixing/pulverizing method, a so-called in-liquid drying method is proposed in which an oil-phase solution in which a toner component is dissolved is treated in a water-phase containing a water-soluble resin to form particles of the solutions, followed by removing a solvent to form powder as described in JP-A Nos. 50-120632, 63-25664, 5-127422, and 8-179556. As a method similar to the in-liquid drying method, there is a method for producing a toner (methods such as described in Japanese Patent Application Publication (JP-B) No. 36-10231 and the like) utilizing a suspension-polymerization method. In these conventional suspension polymerization methods, however, a polymerizable monomer composition to be a binder resin for the toner is limited to those which can be polymerized in a solution (for example, styrene or its derivatives and $\alpha$-methylene fatty acid monocarboxylates). On the contrary, the in- liquid drying method has the advantage that there is not such a limitation and a polyester can be used as the resin for the toner. A method and the like are proposed in JP-A No. 7-152202 in which polyester is dissolved to prepare a solution, which is then treated in a water-phase containing an inorganic dispersant to form particles of the solution. Also, the use of tricalcium phosphate or hydroxyapatite with a grain size of 0.7 to 5 $\mu$m is proposed as the inorganic dispersant to be used as described in JP-A Nos. 7-168395 and 7-271099.

In above mentioned publications in which these in-liquid drying methods are proposed, however, there are no descriptions with regard to a novel invention including addition of a releasing agent such as wax to the toner and any limitation in the chemical structure and configuration of a polyester resin to keep each of the oil-less fixing capability, developing characteristics, and transfer characteristics of the toner at a high level.

Furthermore, in recent years, there has been the requirement to allow a thermal fixing roll to secure the oil-less fixing capability sufficiently not only in the case of using a soft roll such as a conventional silicon roll but also even in the case of using a hard roll such as a Teflon roll. In order to satisfy such a requirement, a low-melting point wax should be added to a toner particles in a high content. When the above-proposed toner resin is used in combination with the low-melting point wax, however, there is the case that only insufficient offset resistance to rolls composed of a highly hard material can be obtained.

The above in-liquid drying method cannot prevent the low-melting wax from oozing out to the surface of the toner. Toners prepared in this method are deteriorated with time in the developing characteristics and is hence insufficient to stand practical use. The above fact has been confirmed in the studies of the present inventors. Specifically, there are no toners produced by in-liquid drying method without bringing above various problems, particularly as color toners, which are improved in both the developing characteristics and the fixing capability. And such toners have been desired.

SUMMARY OF THE INVENTION

The present invention contributes to the provision of a novel toner which is improved in the fixing capability while the developing and transfer characteristics thereof are not damaged and can be used in a fixing system in which no oil is supplied to a fixing roll and to a provision of a method for production of such a toner. The present invention contributes to a provision of a novel toner using a releasing agent and having excellent developing and transfer characteristics and to a provision of a method for production of such a toner. The present invention contributes to a provision of an image forming method capable of forming a multicolor image of high quality and an image with high OHP transmittance and to a provision of a method for production of such a toner.

A first invention relates to a toner comprising a binder resin, a colorant, and a releasing agent wherein the releasing agent has an endothermic starting temperature of 40° C. or more and a melting point of 120° C. or less which are measured using a differential scanning calorimeter, the binder resin contains a linear resin and a non-linear resin, the content of the releasing agent existing at the surface of toner particles is 0 to 30% by weight, and the shape factor MLS2 of the toner particle of said toner which is represented by the following formula (1) is from 100 to 130:

$$\text{MLS2} = [(\text{Absolute maximum length of the toner particle})^2/(\text{Projected area of the toner particle})] \times \pi \times (1/4) \times 100 \quad (1)$$

All or a part of the binder resin may be a polyester produced from a polyvalent alcohol and carboxylic acid. The binder resin may be a mixture of a linear polyester having a weight average molecular weight of $_{2.0\times10}{}^{3}$ to $5.0\times10^4$ and a non-linear polyester having a bridge structure, so that the high temperature offset resistance is improved and the frictional electrification characteristics and developing characteristics are more improved.

When the binder resin contains a linear polyester and a non-liner polyester, it is desirable that the glass transition temperatures of the linear and non- linear polyesters may be from 40° C. to 80° C. and the difference between the glass transition temperatures of the linear and non-linear polyesters may be 22° C. or less. It is also desirable that the softening points of the linear and non-linear polyesters may be from 90° C. to 120° C. and the difference between the softening points of the linear and non-linear polyesters may be 20° C. or less.

Preferably the releasing agent is a wax selected from the group consisting of petroleum waxes, synthetic waxes and natural waxes.

A second invention relates to a method of producing a toner comprising a step of dissolving or dispersing at least a binder resin, a colorant, and a releasing agent in an organic solvent to prepare an oil-phase component and a step of dispersing the oil-phase component in an aqueous medium to granulate the oil-phase component wherein the binder resin contains a linear resin and a non-linear resin, and the releasing agent has an endothermic starting temperature of 40° C. or more and a melting point of 120° C. or less which are measured using a differential scanning calorimeter. In the step of preparing the oil-phase component, the releasing agent may be dispersed in such a manner that the average dispersion particle diameter is 3 $\mu$m.

A third invention relates to an image forming method comprising a step of forming a latent image on an image support member, a step of developing the latent image using a developing agent, and a step of transferring the formed toner image to a transfer member wherein a toner contained in the developing agent comprises a binder resin, a colorant, and a releasing agent, the releasing agent has an endothermic starting temperature of 40° C. or more and a melting point of 120° C. or less which are measured using a differential scanning calorimeter, the binder resin contains a linear resin and a non-linear resin, the content of the releasing agent existing at the surface of toner particles is 0 to 30% by weight, and the shape factor MLS2 of toner particle of said toner which is represented by the following formula (1) is from 100 to 130:

$$\text{MLS2}\ [(\text{Absolute maximum length of the toner particle})/(\text{Projected area of the toner particle})] \times \pi \times (1/4) \times 100 \quad (1)$$

The toner may be produced by a method comprising a step of dissolving or dispersing at least a binder resin, a colorant, and a releasing agent in an organic solvent to prepare an oil-phase component and a step of dispersing the oil-phase component in an aqueous medium to granulate.

DESCRIPTION OF THE PREFERRED EMBODIMENTS

1 Toner 1.1 Binder resin

Figure 1:
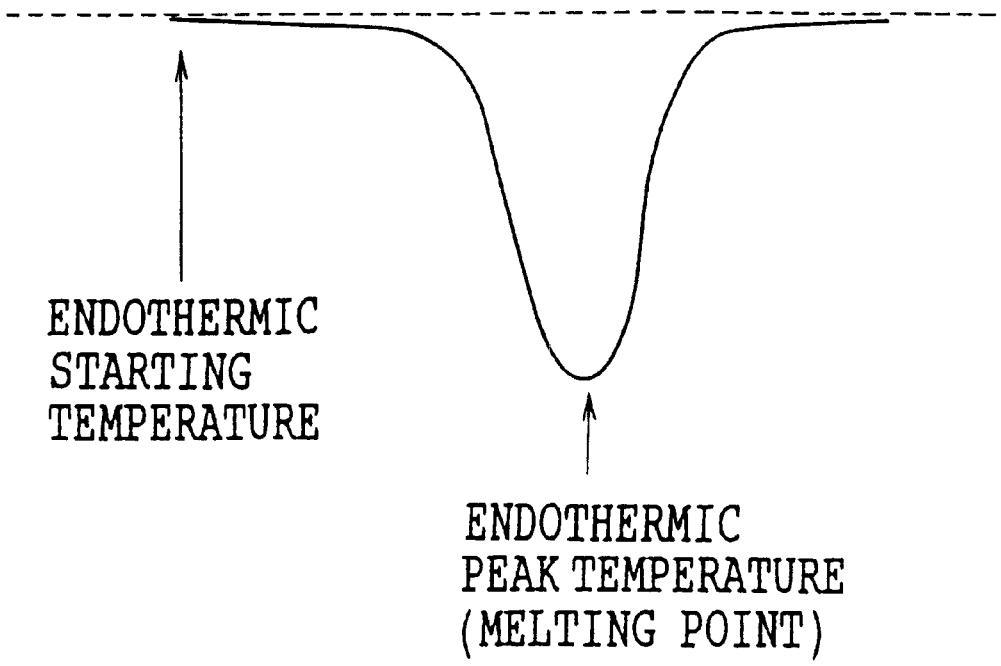
FIG. 1 is a schematic view showing an example of a differential scanning calorimetric curve of a releasing agent.

The binder resin used in the present invention contains a linear resin and a non-linear resin. In this case, the linear resin means a resin having a linear structure which does not substantially possess a bridge point whereas the non-linear resin is a resin which possesses a bridge structure. In the present invention, the non-linear resin is contained in the binder resin thereby preventing the hot offset of the toner in the high-temperature side. Given as examples of the binder resin used in the present invention are a polyester resin, styrene resin, acrylic resin, styrene/acryl-type resin, and polyurethane resin. Particularly a polyester resin is preferably used in case of a color toner.

The binder resin is preferably a mixture of a linear polyester and a non-linear polyester. The linear polyester is polymer made of, as a comprising monomer, linear dicarboxylic acid and/or dicarboxylic acid having a non-substituted functional side chain. On the other hand, the non-linear polyester is a polymer with a three-dimensional bridge structure which is made of, as a part of a comprising monomer, a monomer with three or more valences, or other cross-linking agent. Generally, the crosslinking-type non-linear polyester is superior in prevention of a hot offset occurring in high-temperature. However, as the crosslinking density of polyester increases, the elasticity of polyester increases and the melting rate thereby lowers. There is therefore a case where the smoothness and glossiness of the fixed surface of an image are damaged if only a non-linear polyester with high crosslinking density is used as the binder resin. However even a non-linear polyester with high crosslinking density can restrain the reduction in the melting rate without damaging the smoothness and glossiness of the fixed surface of an image if it is blended with a linear polyester at an appropriate ratio.

Also, when a mixture of a linear polyester and a non-linear polyester is used as the binder resin, an offset at high temperatures can be prevented in an efficient manner without damaging the glossiness and the like of the fixed surface of an image by controlling the proportions, softening points, and glass transition temperatures (hereinafter called "Tg" as the case may be) of the linear and non-linear polyesters.

A linear and non-linear polyesters, both of them have softening points between 90° C. and 120° C., may be used in combination with each other so that the difference in softening point between the both is preferably 20° C. or less and more preferably 10° C. or less.

The softening point herein indicates a temperature calculated by the following method:

Using a descending type flow tester (Shimadzu Corporation) a load of 30 kg/cm is applied to a sample with a size of 1 cm while the sample is heated at a temperature rising rate of 6° C./min by a plunger so as to extrude the sample from a nozzle with a size of a diameter of 1 mm and a length of 1 mm. The heights of the plunger are measured at various temperatures until the sample is thoroughly extruded and are plotted as a function of temperature so that a curve is obtained. When the height of the obtained S-character curve is h, the temperature (the temperature at which a half of the sample is flown out) corresponding to a height of h/2 is defined as "softening point".

When the softening point is less than 90° C., the storage stability of the toner tends to be impaired. For example, if a toner having a softening point less than 90° C. is stored at 45° C. and 80 RH, there is the case that the toner is blocked. When the softening point exceeds 120° C., the minimum fixing temperature of the toner tends to be higher and the color developing characteristics and the OHP transmittance tends to be deteriorated whereby there is the case that the image exhibits a subdued color. There is also the case that the production efficiency of toner particles decreases.

For the proportions of the non-linear polyester and linear polyester, the linear polyester may be contained in the binder resin in a proportion of preferably 60 to 99% weight and more preferably 70 to 90% by weight. If the proportion of the non-linear polyester exceeds 40% by weight, the minimum fixing temperature of the toner tends to be higher and the color developing characteristics and the OHP transmittance tends to be deteriorated. If the proportion of the non-linear polyester is less than 1% by weight, there is the case that only insufficient offset resistance is obtained.

Both of the linear and non-linear polyester may have Tg in a range preferably from 40° C. to 80° C., and more preferably from 50° C. to 70° C. The difference in Tg between the linear and non-linear polyester may be preferably 20° C. or less, and more preferably 10° C. or less. If Tg is less than 40° C., the storage stability of the toner is impaired. If Tg exceeds 80° C., there is the case that the minimum fixing temperature rises and the production efficiency of toner particles is reduced.

The weight molecular weight by GPC of the linear polyester is preferably from $_{2.0\times10}{}^{3}$ to $5.0\times10^4$ and more preferably from $8.0\times10^3$ to $2.0\times10^4$ in view of the transparency and storage stability.

Furthermore, the sum of the acid value and hydroxyl value of the linear polyester and non-linear polyester may be from 5 mg/g (KOH) to 100 mg/g (KOH) respectively. The polyesters preferably have an acid value of 25 mg/g or less and hydroxyl value of 25 mg/g or less preferable. A linear polyester and a non-linear polyester having an acid value and hydroxyl value of the above defined ranges are easily affected by the environment under the conditions of high temperature and high humidity or low temperature and low humidity and the image tends to be deteriorated.

When a mixture of the linear polyester and non-linear polyester is used as the binder resin, other resins may be further combined. Examples of the other resins include a styrene resin, acrylic resin, styrene/acrylic resin, silicone resin, epoxy resin, diene-type resin, phenol resin, terpene resin, cumarin resin, amide resin, amideimide resin, butyral resin, urethane resin, and ethylene/vinyl acetate resin.

As preferably polymerizable monomers of the polyester (including both linear and non-linear polyesters) used as the binder resin, the following compounds may be exemplified:

Given as examples of an alcohol component are diols such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane, and polyoxypropylene(2.0)-polyoxyethylene(2.0)-2,2-bis(4-hydroxyphenyl)propane, ethylene glycol, diethylene glycol, triethylene glycol, polyethylene glycol, propylene glycol, dipropylene glycol, isopentyl glycol, dipropylene glycol, isopentyl glycol, hydrogenated bisphenol A, 1,3-butane diol, 1,4-butane diol, neopenyl glyco, xylyleneglycol, 1,4-cyclohexane dimethanol, glycerol, trimethylolethane, trimethylolpropane, pentaerythritol, bis-(β-hydroxyethyl) terephthalate, tris-(β-hydroxyethyl) isocyanurate, and 2,2,4-trimethylolpentane-1,3-diol.

While, typical examples of an acid component include malonic acid, succinic acid, glutaric acid, dimer acid, phthalic acid, isophthalic acid, terephthalic acid, dimethyl isophthalate, dimethyl terephthalate, monomethyl terephthalate, tetrahydroterephthalic acid, methyltetrahydrophthalic acid, hexahydrophthalic acid, dimethyltetrahydrophthalic acid, endmethylenehexahydrophthalic acid, naphthalenetetracarbuxylic acid, diphenolic acid, trimellitic acid, pyromellitic acid, trimesic acid, cyclopentanedicarboxylic acid, 3,3',,4,4'-benzophenonetetracarboxylic acid, 1,2,3,4-butanetetracarboxylic acid, 2, 2-bis- (4-carboxyphenyl) propane, diimidecarboxylic acid produced from trimellitic acid anhydride and 4,4-diaminophenylmethane, tris-(β-carboxyethyl)isocyanurate, polyimidocarboxylic acid containing an isocyanurate ring, and polyimidocarboxylic acid containing an isocyanate ring produced from a trimer reactant of tolylenediisocyanate, xylylenediisocyanate, or isophoronediisocyanate and trimellitic acid anhydride. These compounds may be used either singly or in combinations of two or more.

When, among these compounds, a cross-linking component such as polyvalent carboxylic acid or alcohol with three valences or more is used, a cross-linked polyester which is desirable in view of the fixing strength and stability such as offset resistance can be produced. Specifically, trivalent carboxylic acids such as trimellitic acid anhydride, 2,5,7-naphthalenetricarboxylic acid, and the like and its derivatives and trivalent alcohols such as glycerol, trimethylolpropane, and the like are exemplified. The combined use of a monomer having a side chain with from 2 to 30 carbons, such as dodecenylsuccinic acid, is preferable because the softening point can be controlled.

1.2 Releasing Agent

The releasing agents which can be used in the present invention are those characterized in that the endothermic starting temperature (tangential released temperature) and melting point calculated from an endothermic curve formed based on data which are measured by a differential scanning calorimeter (hereinafter called "DSC") is 40° C. or more and 120° C. or less respectively. The melting point is preferably from 50° C. to 120° C. and more preferably from 60° C. to 90° C. If the endothermic starting temperature is lower than 40° C., there is the case that the thermal blocking resistance and storage stability of the toner are insufficient, which is undesirable. Also, in the case of storing sheets of paper in the condition that images are overlapped after the images are formed on the sheets of paper, there is the case that an image defect occurs when the sheets of paper are separated. On the other hand, when the melting point exceeds 120° C., there is the case that addition of the releasing agent can impart only an insufficient effect. When a releasing agent having a melting point ranging from 50° C. to 120° C. is used, the releasing agent works more efficiently at the interface of fixing roller-toner and as a result the high-temperature offset can be efficiently prevented even if a releasing agent such as oil is not specially applied to the fixing roller.

Incidentally, the melting point herein is defined as a temperature at the main peak position of the endothermic curve of DSC. An example of the DSC curve of the releasing agent is shown in FIG. 1 as a reference.

As the releasing agent, waxes are preferred. Given as examples of waxes are natural waxes including vegetable waxes such as carnauba wax, cotton wax, haze wax, and rice wax; animal waxes such as beeswax and lanolin; and mineral waxes such as ozokerite and selsyn. Also, petroleum waxes such as paraffin, microcrystalline, and petrolatum can be given as examples of waxes. Other than these natural and petroleum waxes, synthetic waxes including synthetic hydrocarbon waxes such as Fisher-Tropsch wax and polyethylene wax; fatty acid amides such as 12-hydroxystearic acid amide, stearic acid amide, anhydrous phthalic acid imide, and chlorinated hydrocarbons; esters, ketones, and ethers may be used. Other than the above materials, homopolymers or copolymers (for example, a copolymer of n-stearylacrylate-ethylmethacrylate) of polyacrylates such as poly-n-stearylmethacrylate and poly-n-laurylmethacrylate; and crystalline high polymers having a long alkyl group at the side chain are given as examples of the releasing agent. Among these materials, petroleum waxes or synthetic waxes such as paraffin wax and microcrystalline wax are preferred.

In the present invention, among the above exemplified releasing agent, a releasing agent characterized in that the endothermic starting temperature and melting point are 40° C. or more and 120° C. or less respectively must be used.

Furthermore, a releasing agent free from a low molecular weight component having a melting point close to room temperature is preferred so that the releasing agent is exposed at the surface of the toner as hardly as possible.

When an image is recorded onto a transparency film using a toner containing a releasing agent, there is the case that the transmittance of the image after it is fixed slightly decreases. The present inventors have found that this phenomenon occurs more often as the average dispersion particle diameter of the releasing agent dispersed in the toner increases. Specifically, if the average dispersion particle diameter of the releasing agent in the toner is decreased to the extent that it has no influence on the transmittance, the problem of a reduction in the transmittance of an image is solved without being affected by the degree of crystallization of the releasing agent. In the concrete, the average dispersion particle diameter of the releasing agent in the toner is preferably 3 μm or less and more preferably 1 μm or less. In order to disperse the releasing agent in the form of fine particles in the toner, it is preferable that the releasing agent be subjected to micronizing treatment in advance so that the average grain size of the releasing agent is micronized to 3 μm or less and more preferably 1 μm or less.

The average dispersion particle diameter herein of the releasing agent in the toner is defined as the particle diameter which is measured by the following method: First, the toner is solidified using a binder resin, e.g. epoxy. Next, the toner is cut into slice with a thickness of about 1,000 angstroms using a microtome. When the surface in section of the toner is observed using a transmitted light-type microscope, particles of the releasing agent which are phase-separated in the toner can be observed. In the present invention, in order to minimize the error inherent in the cut positions of the particle, 10 data are measured and 5 data lager than else data are selected and the average of the 5 data is used for the dispersion average particle diameter.

The micronization of the releasing agent can be performed by any one of conventionally known methods using an emulsifying and dispersing apparatus or the like as described, for example, in "Reaction Engineering Seminar Report-1, Emulsion Dispersion technology and Grain Size Control of High Polymer Fine Particles, Chapter 3" (published by High Polymer Institute, March, 1995). A method (dissolution/precipitation method) may be also used in which, using a suitable solvent which is compatible with an organic solvent used for producing a toner and does not dissolve a releasing agent at room temperature, a releasing agent is added to this solvent and dissolved under heat, followed by gradually cooling the resulting solution to room temperature to precipitate a micronized releasing agent. In addition, a method (vapor phase vaporizing method) may be utilized in which a releasing agent is heated and vaporized in an inert gas, e.g. helium, to prepare particles of the releasing agent in a vapor phase, in succession the particles are adsorbed to a cooled film or the like to recover these particles, and the recovered particles are dispersed in a solvent. Further, this method may be combined with a mechanical milling method using media, which is more effective.

Figure 2:
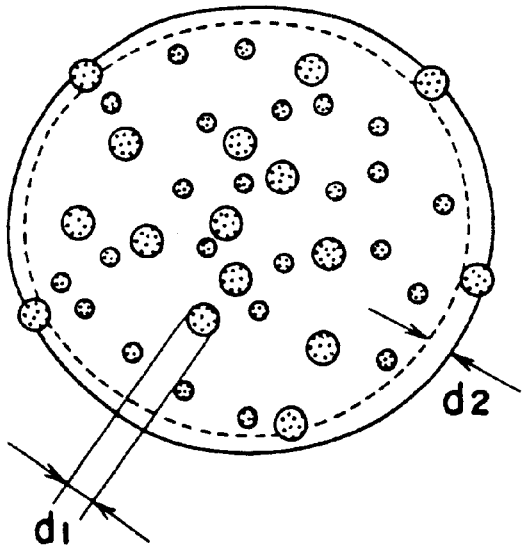
FIG. 2 is a schematically typical view showing toner particles in section.

A dispersion condition of the releasing agent in the toner according to the present invention will be explained with reference to FIG. 2. FIG. 2 is a typical view showing the dispersed conditions of both of releasing agent particles existing in the side of the surface of toner particles and releasing agent particles existing in the side of the core of the toner particles. The releasing agent may be present on the surface of the toner particles according to the present invention in a proportion ranging from 0% by weight to 30.0% by weight. Preferably the releasing agent is present on the surface of the toner particles in a proportion ranging from 1.0% by weight to 10.0% by weight. When the proportion of the releasing agent existing at the surface of the toner exceeds 30% by weight, the powder fluidity of the toner is lowered whereby the toner tends to aggregate especially in a condition of high temperature and high humidity. Also, because the adhesion of the toner tends to be increased, the transfer efficiency is lowered.

In toner particles obtained in a conventional melting/mixing method, the proportion of a releasing agent existing at the surface of toner particles tends to be greater than the above defined range. According to the method of the present invention for producing a toner, the proportion can be controlled in the above defined range. For example, if a releasing agent having a hydrophobic property higher than the binder resin is used, the releasing agent is existing in the side of the core of the toner in a granulation step performed in a water-type medium which is described below whereby the proportion of the releasing agent on the surface can be reduced. The use of a highly hydrophilic releasing agent is undesirable since the proportion of the releasing agent in the surface tends to be greater than the above defined range.

In the case that the proportion of the releasing agent contained in the toner is, for example, in a range from 0.1% by weight to 40% by weight, an excellent offset resistance is exhibited without damaging the developing characteristics and the transfer capability (without to the photorecepter and the charge-donating member occurs) if the proportion of the releasing agent exposed at the surface of the toner is controlled in a range from 1% by weight to 10% by weight. When the proportion of the releasing agent existing at the surface of the toner is less than 1% by weight, only insufficient offset resistance can be obtained.

Meanwhile, the proportion by weight of the releasing agent existing at the surface of the toner particles is calculated as follows: An elemental analysis of the surface of the toner particles is performed according to an X-ray photoelectron spectroscopy (ESCA) to calculate the elemental composition ratio of the surface. On the other hand, the ideal elemental composition ratio of each component (a releasing agent, binder resin, and the like) constituting the toner particles is calculated from the molecular formula of each component. The ratio by weight of the releasing agent existing at the surface can be calculated from the elemental composition ratio obtained by ESCA and the ideal elemental composition ratio calculated from the molecular formula. The surface of the toner particles herein means a layer extending from the top to a depth of 0.1 $\mu$m (shown as $d_2$ in FIG. 2).

In FIG. 2, as for the dispersion diameter ($d_1$) of the releasing agent particles dispersed in the toner particles, the releasing agent is dispersed with a particle diameter of preferably 3 $\mu$m or less and more preferably in a range from 0.1 to 2 $\mu$m.

When the toner is produced by the production method of the present invention, the dispersion condition of the releasing agent in the toner particles depends on the dispersion condition of the releasing agent in oil droplets in a granulation step described below. When an oil phase component containing a monomer composition or a toner composition is dispersed in highly polar water, oil droplets are made. Polar components (compounds having a polar group) contained in the oil droplets tend to exist in the surface layer of the oil droplet which is the boundary between the water phase and the oil droplet. On the other hand, non-polar components contained in the droplet exist in the surface layer of the oil droplet (so-called pseudo-capsule structure) with difficulty. The oil droplets are formed into toner particles which maintain such a distributed condition.

For example, if only a linear resin is used as the binder resin, a large part of the releasing agent (non-polar component) exists in the side of the core of the oil droplet. As a result, in toner particles formed from these oil droplets, almost all releasing agent exists in the side of the core of the toner. The linear resin generally exist in the toner particles in the condition that the molecular chains aggregate. When the toner particles are heated for fixing, release of the aggregation of the molecular chains starts. At the same time, the releasing agent in the toner particles partially melts and oozes from the side of the core to the surface of the toner particles. During this process, the releasing agent gets into the molecular chains which are going to be loosed and a plasticization phenomenon of the linear resin hence occurs in a temperature range for fixing. In a higher temperature range, this phenomenon is further promoted whereby the bonds of the molecular chains are easily broken and as a result an offset occurs. Such a plasticization phenomenon is more significant compared with melt mixing/pulverizing-type toners which contain the releasing agent with a highly density at the surface.

In the present invention, a non-linear resin having a bridge structure is contained in a binder resin. Therefore, a reduction in the viscosity of the entire binder resin is prevented and its aggregation force can be maintained even if the toner is melted by fixing heat. This prevents not only breaking of the bonds of molecular chains but also occurrence of an offset phenomenon.

As aforementioned, preferably a releasing agent used in the present invention is not a low molecular weight component having a melting point close to room temperature or free from such a low molecular weight component. When such a releasing agent is used, oil droplets formed in the granulation step do not tend to create the above pseudo-capsule structure, with the result that the above plasticization phenomenon tends to occur in the obtained toner. The non-linear resin can maintain the aggregation force even if a releasing agent having a small low-molecular weight component and a sharp distribution of molecular weight.

1.3 Colorant

As the colorant used in the present invention, known organic or inorganic pigments, dyes, or oil-soluble dyes may be used. Examples of the colorants include C.I. Pigment Red 48:1, C.I. Pigment Red 57:1, C.I. Pigment Red 122, C.I. Pigment Yellow 17, C.I. Pigment Yellow 97, C.I. Pigment Yellow 12, C.I. Pigment Yellow 180, C.I. Pigment Yellow 185, C.I. Pigment Blue 15:1, and C.I. Pigment Blue 15:3, lamp black (C.I. No. 77266), Rose Bengal (C.I. No. 45432), carbon black, nigrosine dye (C.I. No. 50415B), metal complex salt dye, derivatives of a metal complex salt dye, and mixtures of two or more of these compounds. Examples of the colorants also include various metal oxides such as silica, aluminum oxide, magnetite and various ferrites, cupric oxide, nickel oxide, zinc oxide, zirconium oxide, titanium oxide, magnesium oxide, and mixtures of two or more of these compounds. These colorants should be contained in the toner in an amount sufficient to develop a latent image into an visible image with a sufficiently degree of color gerenation developed. The content of the colorant depends on the particle diameter of the toner and the developing amount. It is generally desirable that the colorant be compounded in an amount of 1 to 100 parts by weight based on 100 parts by weight of the toner.

1.4 Other additives

In the present invention, a charge controlling agent may be one component of the toner, in a manner that the agent is dispersed in an organic solvent together with the binder resin and the like. As the charge control agent which can be used, a compound selected from the group consisting of a metal salt of succinic acid, metal salt of salicylic acid, metal salt of alkylsalicylic acid, metal salt of catechol, metal-containing bisazo dye, tetraphenyl borate derivatives, quaternary ammonium salt, and alkylpyridinium salt and optional combinations of these compounds can be desirably used.

Each additional amount of these compounds is from 0.1% by weight to 10% by weight and preferably from 0.5 to 8% by weight. When the amount is less than 0.1% by weight, an insufficient charge control effect may be obtained. On the other hand, an amount exceeding 10% by weight causes an excess reduction in the resistance of the toner and there is the case that the use of the resulting toner is difficult. Incidentally, a preferred range of the proportion varies corresponding to the particle diameter and the use of the toner and is not hence limited to the above range.

In addition, a metallic soap and an inorganic or organic metal salt may be used in combination with the above charge control agent. Examples of such a metallic soap which can be used in the present invention include aluminum tristearate, aluminum distearate, stearates of barium, calcium, lead, and zinc, or linolenic acid salts of cobalt, manganese, lead, and zinc, octanoates of aluminum, calcium, and cobalt, oleic acid salts of calcium and cobalt, zinc palmitate, naphthoates of calcium, cobalt, manganese, lead, and zinc, and resin acid salts of calcium, cobalt, manganese lead, and zinc. The inorganic or organic metal salts are, for example, salts in which a cationic portion in the metal salt is selected from the group consisting of metals of group I, group II, and group XIII of the periodic table and an anionic portion of the acid is a salt selected from the group consisting of halogens, carbonates, acetates, sulfates, borates, nitrates, and phosphates. The amount of each of these charge control agents or cleaning aids is in a range generally from 0.1% by weight to 10% by weight and preferably from 0.1% by weight to 5% by weight. This is because when the amount is less than 0.1% by weight, a desired effect is insufficient whereas an amount exceeding 10% by weight causes a reduction in the powder fluidity of the toner, which makes it difficult to use the resulting toner.

1.5 Shape of Toner Particles

The shape of the toner particle of the present invention is those in which MLS2 represented by the formula (1) described below is in a range from 100 to 130. The shape of the toner particle can be controlled by appropriately determining condition for production of the toner. For example, when tones are produced by the method of the present invention, the shapes of toners can be changed by controlling the constitutions of the raw materials of the toners and the conditions of the process for removing a solvent from toners after granulation step . The toners can be formed into various shapes, for example, from a spherical shape to an undefined shape. Also toners possessing fine irregularities, wrinkles, pores, or projections can be formed. As for the shape factor MLS2, 100 toner particles images which are magnified under 500 magnification using FE-SEM (S=800) manufactured by Hitachi Ltd. are sampled at random and the information about the toner particles is introduced into, for example, an image analyzer (Luzex-III, manufactured by NIRECO) through an interface ,in order to analyze the images. The value calculated by the following formula using obtained data by analyzing the images is defined as MLS2.

$$MLS2=[(\text{Absolute maximum length of the toner particle})/(\text{Projected area of the toner particle})]\times\pi\times\tfrac{1}{4}\times 100 \quad (1)$$

1.6 External Additive

Known external additives may be added to the toner of the present invention to control the fluidity and the developing characteristics. As the external additives, for example, various inorganic oxide fine particles such as silica, alumina, titania, or cerium oxide or those produced by subjecting these fine particles to hydrophobic treatment as required, vinyl-type polymers, and zinc stearate may be used. The amount of the external additives is preferably in a range from 0.05 parts by weight to 5 parts by weight for a toner before addition of the external additives.

2 Method of Producing a Toner 2.1 Process for Preparation of an Oil-Phase Component The binder resin, colorant, releasing agent, and, as required, other additives are dissolved or dispersed in an organic solvent. As the organic solvent which can be used, any organic solvent can be used insofar as the binder resin can be dissolved in. Examples of the organic solvent to be used, though it may be selected corresponding to the qualities of the binder resin, generally include hydrocarbons such as toluene, xylene, and hexane; halogenated hydrocarbons such as methylene chloride, chloroform, and dichloroethane; alcohols or ethers such as ethanol, butanol, benzyl alcohol, and tetrahydrofuran; esters such as methyl acetate, ethyl acetate, butyl acetate, and isopropyl acetate; and ketones such as acetone, methyl ethyl ketone, diisobutyl ketone, cyclohexanone, and methylcyclohexane. The binder resin should be dissolved in the organic solvents substantially , and furthermore the colorant, releasing agent, and other additives may be dissolved or dispersed in the organic solvent. The ratio by weight of the toner component and the solvent is preferably from 10/90 to 80/20 in light of easy granulation and final toner yield.

2.2 Process for Granulation of the Oil-Phase Component

Next, a process for granulating these oil-phase components so that these components have a prescribed grain size in an aqueous medium will be explained. The aqueous medium contains water as a major component, to which inorganic and organic dispersion stabilizers may be added as required. The dispersion stabilizer forms a hydrophilic colloid. Examples of the inorganic dispersion stabilizer include calcium carbonate, magnesium carbonate, barium carbonate, tricalcium phosphate, hydroxyapatite, silicic acid, diatomaceous earth, and clay. The particle diameter of each of these inorganic dispersion stabilizer is from 1 to 2 $\mu$m or less and preferably 0.1 $\mu$m or less. It is preferred to use the inorganic dispersion stabilizer after it is pulverized into particles with a desired grain size using a ball mill, sand mill, or an attritor, e.g. a wet dispersing machine. If the particle diameter of the inorganic dispersion stabilizer exceeds 2 $\mu$m, the granulated toner has a wide size distribution and cannot be hence used as the toner product.

The inorganic dispersion stabilizer may be used in combination with the organic dispersion stabilizer. Typical examples of the organic dispersion stabilizer include proteins such as gelatin, gelatin derivatives (for example, acetylated gelatin, gelatin phthalate, and gelatin succinate), albumin, and casein, collodion, gum arabic, agar, alginic acid, cellulose derivatives (for example, alkyl esters of carboxymethyl cellulose, hydroxymethyl cellulose, and carboxymethyl cellulose, and synthetic high polymers (polyvinyl alcohol, polyvinyl pyrrolidone, polyacrylamide, polyacrylate, polymethacrylate, polymaleate, and polystyrene sulfonate). These organic dispersion stabilizers may be used either singly or in combinations of two or more.

Preferably the dispersion stabilizer is used in an amount of 0.001 parts by weight to 5 parts by weight for the aqueous medium.

A dispersion stabilizing aids may be added to the aqueous medium. Various surfactants are used as the dispersion stabilizing aids. For instance, there are ionic and nonionic surfactants as the surfactants. Specific examples of anionic surfactants which can be used in the present invention include alkylbenzene sulfonate, alkylphenyl sulfonate, alkylnaphthalene sulfonate, higher fatty acid salts, sulfate of higher fatty acid ester, and sulphonic acid of higher fatty acid ester. As cationic surfactants, primary or tertiary amine salts, quaternary ammonium salts and the like may be used. As the nonionic surfactant, polyoxyethylenenonyl phenyl ether, polyoxyethyleneoctyl phenyl ether, polyoxyethylenedodecyl phenyl ether, polyoxyethylenealkyl ether, polyoxyethylene fatty acid ester, sorbitan fatty acid ester, polyoxyethylene sorbitan fatty acid ester, fatty acid alkylolamide, or the like may be used. These stabilizing aids may be used either singly or in combinations of two or more. Preferably the dispersion stabilizing aids is used in an amount ranging from 0.001 parts by weight to 5 parts by weight for the aqueous medium.

The mixing ratio of the amounts of the oil-phase component and aqueous medium, though it differs depending on the grain size of the finished toner and the production apparatus, is typically from 10/90 to 90/10.

Preferably the oil-phase component is granulated in the aqueous medium under a high shearing condition. Particularly if the toner particles having diameters in a range from 5 to 9 $\mu$m are produced, it is necessary to pay attention to the selection of a dispersing machine having a high speed shearing mechanism. Among these dispersing machines, high-speed blade rotation type and forced gap-passing type homogenizers such as various homomixers, homogenizers, colloid mills, ultra-tarax, and clear mill are facilitated for use.

During or after the process for granulating the oil-phase component, the organic solvent may be removed. The removal of the organic solvent may be performed at normal temperature or under reduced pressure. In the case that it is performed at normal temperature, the organic solvent is preferably removed at a temperature in a range of which is lower than the boiling point of the organic solvent and does not largely exceed Tg of the binder resin. When the temperature for the removal of the solvent largely exceeds Tg, toners are probably fused each other, which is undesirable. Though a desirable temperature range depends on the boiling point of the organic solvent and Tg of the used binder resin, it is convenient to stir at a temperature close to 40° C. for 3 to 24 hours. When the removal is performed under reduced pressure, it is convenient to perform at a pressure of 20 to 150 mmHg.

1.7 Other Processes

Preferably the resulting toner is washed after a solvent is removed. For the washing, acids, e.g. hydrochloric acid, nitric acid, formic acid, or acetic acid, in which the dispersion stabilizer can be dissolved, can be used. Because these inorganic and organic dispersion stabilizers are hygroscopic, there is the case that the chargeabilities and the like of the toners depend on humidity when these dispersion stabilizers are remaining at the surface of the toners. It is therefore desirable that the dispersion stabilizer is removed from the surface of the toner by washing in order to eliminate an adverse influence on the chargeability and powder fluidity of the toner. When the inorganic dispersant is an acidic material, the washing may be carried out using an aqueous alkali.

The toner washed with an acid may be again washed with an aqueous alkali such as sodium hydroxide as required. By this measures, a part of ionic materials, which remains on the surface of the toner and is insolubilized under an acidic atmosphere, is again solubilized by the aqueous alkali and removed, whith the result that the chargeability and the powder fluidity of the toner is improved. This is convenient to improve the chargeability and powder fluidity of the toner. In the case of an aqueous alkali treatment, the toner may be again washed using an acid.

Furthermore, these washing treatments using an acid or alkali effectively remove free releasing agents adhering to the surfaces of the toners. The washing treatment can be more efficiently carried out by appropriately selecting a stirrer and a ultrasonic dispersing apparatus used in the washing treatment as well as by controlling conditions of the pH of the washing liquid, number of washings, and washing temperature, and the like. After that, processes such as filtration, decantation, and centrifugation were performed, followed by drying to obtain toner particles.

3. Image forming method

The toner of the present invention can be used in a known dry electrostatic charge developing method without any limitation. It can be adapted to, for example, a two-component developing method such as a cascade method, magnetic brush method, and micro-toning method and a one-component developing method such as an electroconductive one-component developing method and an isolation one-component developing method as well as a non-magnetic one component developing method. It is possible to design a unique process which effectively utilizes the low adhesion of the toner which is caused by the spherical shape of the toner. For example, using a full color copier which develops and transfers a plurality of toner images, the amount of a toner used for developing an electrostatic image on a photorecepter increases more than that of a conventional monochromatic toner. It is therefore difficult to improve the efficiency in transferring the toner image from the surface of a photorecepter to a recording material. Because of this, in the formation of a color image, four toners with different colors are not uniformly transferred. Furthermore, when an intermediate transfer is used, problems with respect of a color shade or color balance tend to occur and it is not hence easy to output a full-color image of high quality in a stable manner. A reduction in the transfer efficiency of the toner is seen from around when MLS2 of the toner exceeds 130. When the aforementioned full-color copier is used, preferably a toner having an MLS2 of about 100 to 120 is used in order to improve the transfer efficiency. If the production method of the present invention is used, MLS2 of the toner can be controlled in a range from 100 to 140. Accordingly, if MLS2 is controlled to produce a toner having a high efficiency in the transfer characteristics and this toner is used, a small size and simple process without a cleaning member can be designed.

Figure 3:
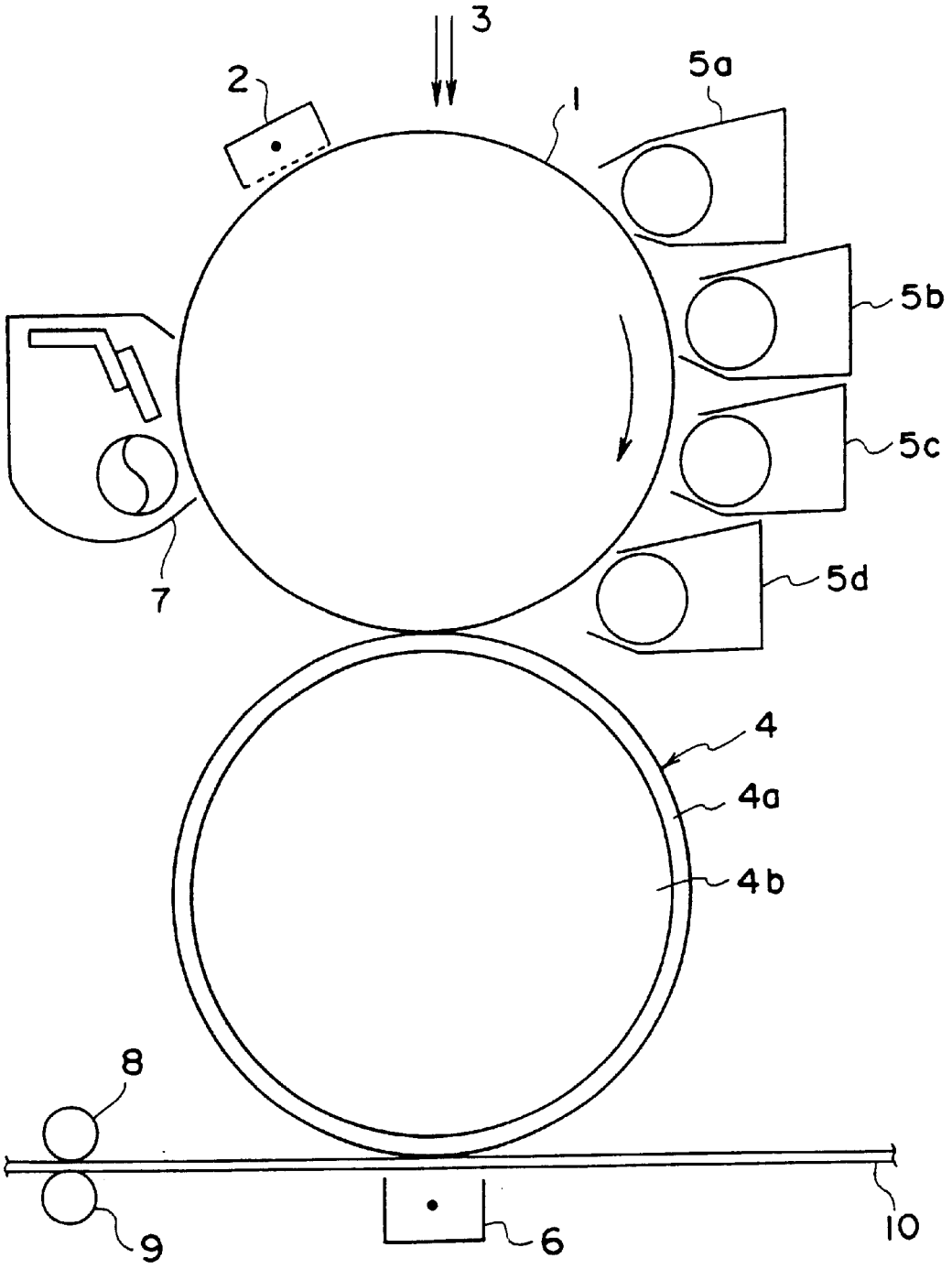
FIG. 3 is a schematically sectional view of an embodiment of an image forming device which can use the toner of the present invention.

FIG. 3 shows a schematically sectional view showing an embodiment of an image forming device using the image forming method of the present invention. The image forming method using the toner of the present invention is not limited to this. A photorecepter 1 is a sensitive drum or belt having a photo-electroconductive insulating layer such as a-Se, OPC, a-Si, and ZnO. Among these, OPC or a-Si photorecepter is preferably used. The photorecepter 1 is charged in advance by a corona charger 2. As a charging means, a contact-type charger using a roller or a magnetic brush as well as a non-contact-type charger such as a corona charger may be used. Next, the photorecepter 1 is irradiated image-like with light 3 using an exposure means such as a laser, LED, or EL array to form a latent image on the photorecepter 1. A developing agent containing the toner of the present invention is stored in a developing units 5*a* to 5*d*. In a full-color device using a subtractive color mixing system, each of developing agents containing toners with cyan, magenta, yellow, and black colors respectively are stored.

The latent image on the photorecepter 1 is exposed to a developing agent at the position opposite to the developing unit 5*a*, (5*b*, 5*c*, 5*d*) containing a developing agent with the corresponding color whereby it is developed. The developing method may be either a magnetic brush developing method or a non-magnetic one-component developing method. The toner image formed on the photorecepter 1 is transferred on to an intermediate transfer member 4. The intermediate transfer member 4 is provided with an electroconductive core bar 4*b* with a pipe-line form and an elastic layer 4*a* whose electric resistance is controlled, the elastic layer 4*a* being disposed on the periphery of the core bar. The toner image transferred to the intermediate transfer member 4 is conveyed by the intermediate transfer member 4 to the position facing a transfer member 10. At that position, the toner image on the intermediate transfer member 4 is transferred on to the surface of the transfer member 10 to which a bias with a polarity opposite to that of the frictional charge of the toner is applied by a charger 6. This step is repeated to form a full-color image on the transfer member 10.

The full-color image formed on the transfer member 10 is conveyed to a nip portion of an elastic pressure roller 9 which is allowed to contact under pressure with a heat roller 8 provided with a built-in heating element such as a halogen heater. The full-color image is allowed to pass between the rollers whereby the toner image is fixed.

The photorecepter 1 is provided with a removable cleaning means 7, though the cleaning means may be omitted.

Figure 4:
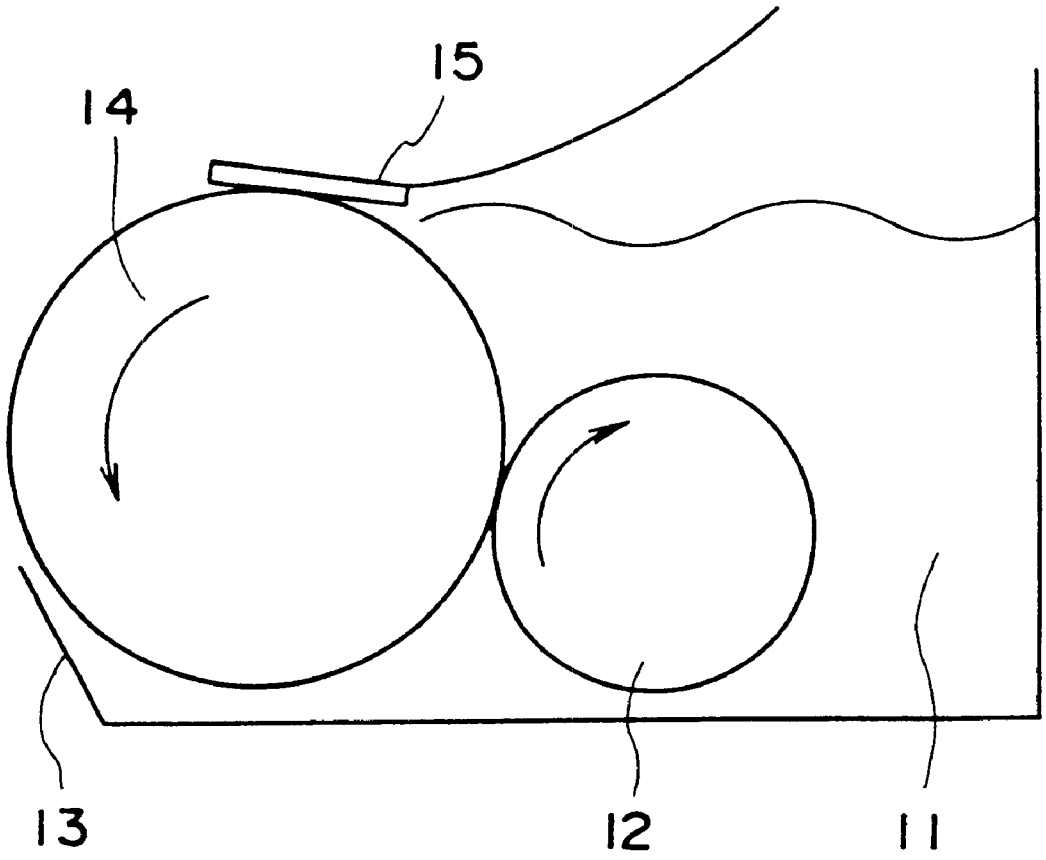
FIG. 4 shows a schematically sectional view of an embodiment of a developing unit (non-magnetic and one-component developing unit) of an image forming device which can use the toner of the present invention.

FIG. 4 shows a schematic view of an embodiment of a developing unit in the case of using a non-magnetic/one-component developing unit as a developing device in the image forming device of the present invention. In this figure, a developing unit comprises a toner reservoir 11, a toner feed roll 12, a seal 13, a developing roll 14 and a regulating blade 15 which electrifies a toner and allows the toner in the form of a thin layer.

In the toner of the present invention, a non-linear resin (cross-linking resin) is added to a binder resin whereby internal aggregation force can be increased and peeling from a fixing roll is well-achieved. Also, because the non-linear resin is added, the heat blocking resistance is improved. It is conventionally known that when a releasing agent such as wax is added to a binder resin to improve the offset resistance, internal aggregation force is decreased and the phenomenon occurs in which a toner is peeled from a fixing roll with difficulty in the case of melting the toner during a fixing step. Particularly, when adopting a production method comprising a step of granulating an oil-phase component in an aqueous medium, there is the problem that the tendency in which a large part of releasing particles tends to exist inside toner particles is significant and as a result the binder resin, especially the linear resin is plasticized and the bonds of the resin are broken at a fixing temperature whereby an offset phenomenon is allowed to occur easily. In the present invention, these problems are solved as aforementioned. Also, in the toner of the present invention, an excessive releasing agent does not appear at the surface of the toner and the releasing agent exists in the side of the surface of the toner in an appropriate amount ranging from 0% by weight to 30% by weight. Therefore, if this toner is used, filming can be prevented while maintaining better offset characteristics.

In the method for production of a toner according to the present invention, an oil-phase component is prepared in advance and the oil-phase component is then granulated in an aqueous medium. The method of the present invention therefore has the following effects compared with the method in which the raw materials for the toner are melted and mixed, followed by pulverizing. If a trial is made in which a non-linear resin is added to a binder resin to improve the internal aggregation force as aforementioned in the above melting and mixing method, it is difficult to heat-melt a mixture of a linear resin and non-linear resin. There is the case that an abnormal phenomenon occurs depending on the condition of melting and kneading. For example, when the mixture is intended to be melted under high temperature for melting the non-linear resin, the molecular chain of the linear resin is broken and the average molecular weight of the binder resin becomes a low molecular weight. As a consequence, there is the case that the characteristics of the toner is adversely affected. On the other hand, according to the production method of the present invention, high temperature heat treatment of the binder resin is not required and any variation in the distribution of the molecular weight of the binder resin is not observed even after the granulation step.

Furthermore, because the releasing agent has almost no adverse influence on the viscoelasticity and aggregation force of the binder resin, a releasing agent with a low melting point can be added in a proportion higher than in case of a customary toner. As a result, even in the case of using a fixing roll composed of a hard material, e.g. a TEFLON roll, no adhesion of the toner to the fixing roll occurs and it is hence unnecessary to supply oil to the fixing roll. Accordingly, the use of the toner of the present invention enables to realize small size and inexpensive color copiers and printers.

According to the production method of the present invention, a releasing agent with a low melting point, which can be used in conventional melt mixing/pulverizing method with difficulty, can be dispersed in polyester resin, which can be used as a binder resin in a conventional suspension/polymerization method with difficulty. The shape of the toner can be also controlled. As a result, a toner having excellent powder characteristics and high transfer efficiency can be designed.

Furthermore, if a releasing agent formed into fine particles is used as the releasing agent of the present a invention, the dispersing unit of the releasing agent in the toner can be micronized. When a toner having such a releasing agent is used to form an image, especially a color image, the quality of the image is improved and, particularly, a highly transmittable OHP image can be formed.

EXAMPLES

The present invention will be illustrated in more detail by way of examples and comparative examples, which are not intended to be limiting of the present invention. In Examples and Comparative Examples, "parts(part)" means "parts by weight(part by weight)".

Example 1

Production of a Resin A (Linear Polyester)

| | |
|---|---|
| Polyoxypropylene(2.2)-2,2-bis(4-hydroxyphenyl)propane | 1050 parts |
| Fumaric acid | 520 parts |
| Hydroquinone (polymerization inhibitor) | 1 part |

The above materials were placed in a 31 glass four necks flask together with an esterification catalyst (dibutyltin oxide). A stainless stirring rod, a down-flow type condenser, and a nitrogen introduction pipe were attached to the flask. The mixture was stirred in a nitrogen stream being heated at 230° C. with an electric heat mantle heater under normal pressure during the first half, and at 200° C. under reduced pressure during the second half to advance reaction. The resulting linear polyester had an acid value of 12.6 mg/g (KOH), a hydroxyl value of 8.9 mg/g (KOH), a Tg of 66° C., and a weight average molecular weight (GPC) of 20000.

Production of a Resin B (Non-Linear (Cross-Linking) Polyester)

| | |
|---|---|
| Polyoxypropylene(2.2)-2,2-bis(4-hydroxyphenyl)propane | 460 parts |
| Polyoxyethylene(2.2)-2,2.bis(4-hydroxyphenyl)propane | 425 parts |
| Trimellitic acid anhydride | 48 parts |
| Dimethylterephthalic acid | 50 parts |
| Dodecenylsuccinic acid anhydride | 270 parts |
| Dibutyltin oxide | 1 part |

Using the above materials, a reaction was advanced in the same manner as in the production example 1. The resulting cross-linked polyester had an acid value of 10.8 mg/g (KOH), a hydroxyl value of 28.4 mg/g (KOH), a Tg of 62° C., and a weight average molecular weight (GPC) of 95000.

A resin C (cross-linked polyester) and a resin D (linear polyester) were produced in the same manner as above. The structural components, proportions, and properties of all the obtained resins are shown in Table 1 at a time.

TABLE 1

| Raw material monomer Type | A Linear | B Cross-linked | C Cross-linked | D Linear |
|---|---|---|---|---|
| Polyoxypropylene(2,2)-2,2bis-(4-hydroxyphenyl) propane | 1050 parts | 460 parts | 475 parts | 1050 parts |
| Polyoxyethylene(2,2)-2,2bis-(4-hydroxyphenyl) propane | | 425 parts | 410 parts | |
| Fumaric acid | 520 parts | | | |
| Dimethylterephthalic acid | | 50 parts | 50 parts | 580 parts |
| Trimellitic acid anhydride | | 48 parts | | |
| Dodecenylsuccinic acid | | 270 parts | | |
| Glycerol | | | 62 parts | |
| Dibutyltin oxide (catalyst) | 0.1 parts | 0.1 parts | 0.1 parts | 0.1 parts |
| Glass transition temperature (° C.) | 66 | 62 | 68 | 59 |
| Acid value (KOH mg/g) | 12.6 | 10.8 | 20.3 | 17.5 |
| Hydroxyl value (KOH mg/g) | 8.9 | 28.4 | 31.2 | 26.9 |
| Weight average molecular weight | 20000 | 95000 | 12000 | 58000 |
| Softening point (° C.) | 101 | 114 | 110 | 105 |

(A) Preparation of a Pigment (Colorant) Dispersion Solution

A pigment dispersion solution was prepared by the following procedures:

| | |
|---|---|
| Copper phthalocyanine pigment: (C.I. Pigment Blue 15:3, Cyanine Blue 4933M; manufactured by Dainichiseika Colour & Chemicals Mfg. Co., Ltd.) | 98 parts |
| Pigment dispersant: SOLSPERSE 24000 (manufactured by SENECA Co., Ltd.) | 2 parts |
| Ethyl acetate | 100 parts |

Pigment dispersant: (SOLSPERSE 24000 2 parts (manufactured by SENECA Co., Ltd.)

Glass beads were added to a dispersion solution of the above material composition, which mixture was placed in a sand mill dispersing machine. The mixture was dispersed for 3 hours in a high speed stirring mode while the surrounding of a dispersion vessel was cooled. The dispersed mixture was diluted by ethyl acetate to prepare a pigment dispersion solution with the concentration of a pigment being 10% by weight.

(B) Production of Fine Particles of Wax (Releasing Agent)

A dispersion solution of particulate wax was prepared by the following procedures:

| | |
|---|---|
| Paraffin wax: (DSC endothermic starting temperature: 55° C., melting point: 85° C., melting latent heat: 193 mJ/mg) | 15 parts |
| Toluene | 85 parts |

In a dispersing machine having a stirring blade and means for circulating a heating medium around a vessel, the above components are placed. The mixture was gradually heated while stirring at 83 rpm and finally the mixture was stirred for 3 hours maintaining a temperature of 100° C. Next, the resulting mixture was cooled at a rate of about 2° C. per minute to room temperature while continuing stirring, so as to precipitate particulate wax. The average grain size of wax which was measured using a laser diffraction/scattering grain size measuring device LA-700 (HORIBA Ltd.) was about 1.02 $\mu$m. A dispersion solution of wax was again dispersed at a pressure of 500 Kg/cm$^2$ using a high pressure homogenizer APV GAULIN HOMOGENIZER 15MR-type. The grain size of wax which was measured in the same manner as above was 0.81 $\mu$m. The prepared dispersion solution was diluted using ethyl acetate so that the concentration by weight of wax was 15% by weight.

(C) Preparation of an Oil-Phase Component

An oil phase component was prepared in the following procedures:

| | |
|---|---|
| Polyester resin A: | 70 parts |
| Polyester resin B: | 30 parts |
| Pigment dispersion solution (concentration of pigment: 10% by weight) | 50 parts |
| Dispersion solution of particulate wax (concentration of wax: 15% by weight) | 33 parts |
| Ethyl acetate | 32 parts |

The preparation was made after it was confirmed that the polyester resins in the above components were dissolved in ethyl acetate. The above oil-phase components was placed in a homomixer (Ace Homogenizer manufactured by NIPPON SEIKI Co, LTD). These components were then stirred at 15000 rpm for two minutes to prepare a uniform oil-phase component.

(D) Preparation of a Water-Phase

An aqueous medium was prepared by the following procedures.

| | |
|---|---|
| Calcium carbonate (average particle diameter: 0.03 μm) | 60 parts |
| Pure water | 40 parts |

The above materials were stirred for 4 days using a ball mill. The average grain size of calcium carbide which was-measured using the aforementioned laser diffraction/scattering grain size measuring device LA-700 (Horiba Seisakusho) was about 0.08 μm.

On the other hand, the following proportion of carboxymethyl cellulose was dissolved in pure water to an aqueous medium similarly.

| | |
|---|---|
| Carboxymethyl cellulose (Cellogen BSH; Dai-ichi Kogyo Seiyaku Co., Ltd.) | 2 parts |
| Pure water | 98 parts |

(E) Process for Production of a Toner (Including a Granulation Step)

The following materials were used to produce a toner:

| | |
|---|---|
| Oil phase component produced in the above (C) | 60 parts |
| Dispersion solution of calcium carbide produced in the above (D) | 10 parts |
| Aqueous carboxymethyl cellulose solution (D) produced in the above (D) | 30 parts |

The above materials was placed in a colloid mill (NIPPON SEIKI Co, LTD). These materials were emulsified at 8000 rpm for 20 minutes in the condition that the gap interval was 1.5 mm. Next, the above emulsified substance was placed in a rotary evaporator and a solvent was removed at room temperature under reduced pressure as low as 30 mmHg for 3 hours. 12 N hydrochloric acid was then added until the pH was 2 to remove calcium carbonate from the surface of the toner. After that, 10 N sodium hydroxide was added until the pH was 10. Furthermore, the mixture was stirred using a stirrer in a ultrasonic washing vessel and the stirring was continued for one hour. In addition, decanting was carried out and the supernatant solution was exchanged three times and washed, followed by drying. Then the toner was taken out. Measurements of the toner were performed using a Coulter counter TA-II type (manufactured by Coulter Co., Ltd.). The volumetric grain size was 7.8 μm, GSD (which is an average volumetric grain size, specifically, calculated by extracting the square root of d84/d16) which is the index of grain size was 1.22, and the shape factor MLS2 was 107.

In addition, the colorant was altered to C.I. Pigment Yellow 180, C.I. Pigment Red 57, and carbon black (#4000, manufactured by Mitsubishi Chemical Industries Ltd.) to obtain an yellow toner, magenta toner, and black toner in the same manner as above. The properties of the toner of each color are shown in Table 2.

TABLE 2

| | Volumetric average diameter (μm) | GSD | MLS2 | Releasing agent Dispersion diameter (μm) | Amount of releasing agent on the surface of toner particles (wt %) |
|---|---|---|---|---|---|
| Cyan toner | 7.8 | 1.22 | 107 | 1.2 | 5.1 |
| Yellow toner | 7.8 | 1.25 | 108 | 0.8 | 4.2 |
| Magenta toner | 7.1 | 1.29 | 108 | 1.1 | 6.3 |
| Black toner | 7.0 | 1.23 | 107 | 0.9 | 7.8 |

(F) Preparation of a Developing Agent and Evaluation in an Actual Machine 0.5% by weight of silica (R972, Nippon Aerogyl) was added to the toner prepared in (E) using a Henshel mixer. 0.5% by weight of polymethylmethacrylate was added to F300 (Powderteck Co., Ltd.), used as a carrier core, in order to coat the core thereby producing a carrier. The above-mentioned toner and the carrier were blended under control so that the concentration of the toner was 8% by weight, to produce a developing agent. The developing agents with each color had a charge of −15 to −20 μC/g.

The developing agents were also evaluated according to the following evaluation methods:

[Evaluation Method for a Developing Agent]

A modification of A-Color 635 (manufactured by Fuji Xerox Co., Ltd.) was used as an image output evaluation device (FIG. 3 shows a schematic view of the image output evaluation device). An image was fixed in an oil-less condition without supplying any oil to a heat fixing roll.

Concrete experimental conditions are as follows: Image Formation Condition

| | |
|---|---|
| Photorecepter: | OPC(ϕ84) |
| ROS: | LED (400 dpi) |
| Process speed: | 160 mm/s |
| Latent image potential: | Background = −550 V<br>Image section = −150 V |
| Developing roll (common to first to fourth developing units) | |

Fixed magnet, sleeve rotation type
Flux density of the magnet=500 G (on a sleeve)
Diameter of the sleeve=ø025
Rotation speed of the sleeve =300 mm/s

| | |
|---|---|
| Interval between the photorecepter and the developing roll (common to first to fourth developing units): | 0.5 mm |
| Interval between the regulating member for regulating the layer thickness of the developing layer and the developing roll (common to first to fourth developing units): | 0.5 mm |
| Developing bias (common to first to fourth developing units): | |

DC component=−500 V
AC component=1.5 kVP-P (8 kHz)
Transfer condition:
Collotron transfer (wire diameter=85 μm)
Fixing condition:
Fluorine roll, no oil supply
Evaluation condition:
Normal temperature and normal humidity (23° C., 50% RH) and high temperature and high humidity (28° C., 85% RH)

In the above conditions, an image was formed and the quality of the image was evaluated in the following manner:

Incidentally, the density of the image was measured using a color reflection densitometer X-RITE 404A.

(1) Evaluation of Image Quality

Reproducibility of the Color Tone of an Image

An image was recorded onto an OHP sheet to measure each transmittance of light of various wavelengths (cyan: 480 nm, magenta: 680 nm, and yellow: 580 nm), light of each color, thereby evaluating the reproducibility of the color tone of the image. A spectrophotometric system U-3210 (manufactured by Hitachi Ltd.) was used as a device for measuring the transmittance.

Strength of the Quality of a Fixed Image

As for the strength of the quality of a fixed image, the image recorded on to common paper was fixed in the condition that the temperature of the roll was 180° C. After the fixed image was rubbed to examine whether the toner was peeled off or not, thereby to evaluate according to the following criteria:

○: The toner was not peeled off.
×: The toner was peeled off.

(2) Evaluation of Transfer Efficiency

For the measurement of the transfer efficiency 1 in transferring from the photorecepter to the intermediate transfer member, a toner image on the photorecepter was sampled using an adhesive tape to measure the density of the image using a color reflection densitometer. Next, a toner image was again produced, transferred to the intermediate transfer member, and sampled using an adhesive tape in the same manner as above to measure the density of the image. The transfer efficiency is calculated according to the following formula:

Transfer efficiency 1=(Density of the toner image sampled from the intermediate transfer member)/(Density of the toner image sampled from the photorecepter)

The transfer efficiency in transferring from the intermediate transfer member to the transfer member is calculated according to the following formula:

Transfer efficiency2=(Density of the toner image sampled from the transfer member)/(Density of the toner image sampled from the intermediate transfer member)

An overall transfer efficiency is calculated according to the following formula:

Transfer efficiency=Transfer efficiency 1×Transfer efficiency 2

(3) Evaluation of the Thermal Blocking Characteristics of the Toner 5g of the toner was allowed to stand at 45° C. and 50% RH for 17 hours in a chamber. The temperature of the toner was returned to room temperature. A mesh with an aperture of 45 μm was charged with 2 g of the toner and vibrated in a fixed condition. The amount of the toner remaining on the mesh was measured to calculate the weight ratio. This calculated value was defined as the thermal blocking index. The smaller the thermal blocking index is, the lower the level of deterioration of the toner is and the better the toner is. The evaluation was made according to the following criteria:

○: The thermal blocking index is less than 6%, and the thermal resistance of the toner is good.
Δ: The thermal blocking index is 6% or more and less than 10% and, the thermal resistance of the toner is normal.
×: The thermal blocking index is 10% or more, and the thermal resistance of the toner is bad.

(4) Offset Temperature

An image recorded on the paper was fixed under heat at 130° C. to 220° C. to examine the temperature at which an offset phenomenon occurred. In the case that the temperature at which an offset occurs is 180° C. or more, the offset resistance is good (○) In the case that the offset occurs at temperatures over 150° C. and less than 180° C., the offset resistance is normal (Δ) and in the case that the offset occurs at temperatures less than 150° C., the offset resistance is inferior (×)

[Result of evaluation]

Each of the developing agents having each color which was prepared in Example 1 exhibited 98–99% transfer efficiency 1 in transferring from the photorecepter to the intermediate transfer member, 98–99% transfer efficiency 2 in transferring from the intermediate transfer member to the transfer member, and an overall transfer efficiency as high as 96 to 98%.

The resulting image exhibited excellent characteristics with high resolution. The oil-less fixing capability was high and the occurrence of the offset phenomenon was prevented. In addition, as a result of continuous copying of 30000 sheets, an image after 30000 sheets were copied was excellent without any difference from that in the primary stage. Also, there was no disorder in the image even under the condition of high temperature and high humidity. The hot offset temperature, evaluation of the strength of the fixed image, OHP transmittancy (evaluation of the reproducibility of the color tone of the image), and thermal blocking index of the developing agents having each color are shown in Table 3 described below.

TABLE 3

| | Offset temperature (° C.) (determination) | Strength of the fixed image (rubbing method) | OHP transmittancy (%) | Thermal blocking index (%) (determination) |
|---|---|---|---|---|
| Cyan toner | 190(○) | ○ | 89 | 5.3(○) |
| Yellow toner | 200(○) | ○ | 90 | 4.9(○) |
| Magenta toner | 190(○) | ○ | 89 | 3.1(○) |
| Black toner | 200(○) | ○ | — | 3.9(○) |

Furthermore, an image was fixed at a fixing temperature of 155° C. to measure the glossiness of the fixed image. The glossiness of an image of a solid portion which contained 0.6 to 0.7 mg/cm of a toner adhered was measured in the condition that the measurement incident angle was 60°/60°. As a result, every image of each color exhibited a glossiness as high as 20.

Examples 2 to 5

A toner was produced in the same manner as in Example 1 except that the linear polyester, cross-linked polyester, pigment, and wax used in Example 1 were replaced with those listed in Table 4. A list of the results of evaluation made in the same manner as in Example 1 is also shown in Table 5.

Comparative Example 1

A toner was produced in the same manner as in Example 1 except that polypropylene wax (DSC: 70° C., melting point: 140° C., melting latent heat: 290 mJ/mg) was used as the releasing agent instead of wax used in Example 1. The average grain size of wax in the toner which was measured was about 2.7 μm. The average grain size and GSD of the toner were 8.3 μm and 1.35 respectively.

In addition, a developing agent was prepared in the same manner as in Example 1. Using the same actual machine as in Example 1, an image was formed. Evaluation of the image quality and the like were made in the same manner as in Example 1.

The hot offset of the image occurred at 145° C. and the oil-less fixing capability was insufficient. The thermal blocking index was 8.4%. The OHP image had dark half-tone. Though an image formed in the primary stage exhibited high resolution, continuous copying of 30000 sheets resulted in that an image after 30000 sheets were copied was slightly reduced in quality in contrast with that in the primary stage. The results are shown in Table 5.

Comparative Example 2

A toner was produced in the same manner as in Example 1 except that the following resin E (linear polyester) resin E was used instead of the resin A (linear polyester) and the resin B (cross-linked polyester) was not used.

(Production of Resin E (Linear Polyester))

| | |
|---|---|
| Polyoxypropylene(2.2)-2,2-bis(4-hydroxyphenyl)propane | 1250 parts |
| Terephthalic acid | 820 parts |
| Hydroquinone (polymerization inhibitor) | 1 part |

The above materials were placed in a 31 glass four necks flask together with an esterification catalyst (dibutyltin oxide). A stainless stirring rod, a down-flow type condenser, and a nitrogen introduction pipe were attached to the flask. The mixture was stirred under a nitrogen stream being heated at 230° C. using in an electric heat mantle heater under normal pressure during the first half, and at 200° C. under reduced pressure during the second half to advance reaction. The resulting linear polyester had an acidvalue of 20.6 mg/g (KOH) a hydroxyl value of 34.9 mg/g (KOH), a Tg of 70° C., and a weight average molecular weight (GPC) of 20000.

The average grain size of wax in the toner which was measured was about 2.4 μm. The average grain size and GSD of the toner were 7.8 μm and 1.35 respectively.

In addition, a developing agent was prepared in the same manner as in Example 1. Using the same actual machine as in Example 1, an image was formed. Evaluation of the image quality and the like were made in the same manner as in Example 1.

The hot offset of the image occurred at 155° C. and the. oil-less fixing capability was insufficient. The thermal blocking index was 19%. The OHP image had dark half-tone. As a result of continuous copying, a fog on the background occurred just after 1000 sheets were copied exhibiting deteriorated image quality. After 1000 copies, the fog on the background was increased as the copying was continued. After 5000 sheets were copied, the inside of the copying machine was significantly soiled. Also, the evaluation of an image in the condition of high temperature and high humidity showed that the image was disordered more significantly. The results are shown in Table 5.

Comparative Example 3

A toner was produced in the same manner as in the examples except that the linear polyester was not used. The results are shown in Table 5.

TABLE 4

| | Resin | | | Releasing agent | | | |
|---|---|---|---|---|---|---|---|
| | | | | | DSC endothermic | | |
| | Linear | Cross-linked | Pigment | Material | Melting point (° C.) | starting temperature (° C.) | Grain size (μm) |
| Example 2 | A | B | C.I. Pigment Blue 15:3 | Paraffin | 75 | 55 | 0.8 |
| Example 3 | D | C | C.I. Pigment Red 57 | Micro-crystalline | 101 | 61 | 1.1 |
| Example 4 | D | C | C.I. Pigment Yellow 180 | Maleic acid anhydride modified polyethylene | 105 | 60 | 1.3 |
| Comparative Example 1 | A | B | C.I. Pigment Blue 15:3 | Polypropylene | 140 | 70 | 2.7 |
| Comparative Example 2 | E | None | C.I. Pigment Blue 15:3 | Paraffin | 75 | 55 | 2.4 |
| Comparative Example 3 | None | B | C.I. Pigment Blue 15:3 | Paraffin | 85 | 60 | 3.5 |

TABLE 5

| | Properties of toner | | | | | | | Thermal | | Image under |
|---|---|---|---|---|---|---|---|---|---|---|
| | Volumetric average diameter (μm) | MLS2 | Dispersion diameter of releasing agent (μm) | Amount of releasing agent on the surface (wt %) | Offset temperature (° C.) (determination) | Strength of fixed image | OHP trans-mittancy | storage stability index (deter-mination) | Image after 3000 copies | high temperature and high humidity |
| Example 2 | 7.8 | 105 | 0.8 | 9.3 | 190 (○) | ○ | 90% | 4.9% (○) | Good | Good |
| Example 3 | 8.2 | 106 | 0.9 | 7.3 | 195 (○) | ○ | 88% | 3.9% (○) | Good | Good |
| Example 4 | 7.6 | 109 | 0.9 | 13.5 | 195 (○) | ○ | 89% | 3.0% (○) | Good | Good |
| Comparative Example 1 | 8.3 | 105 | 4.1 | 8.3 | 145 (X) | ○ | 77% | 8.4% (Δ) | Slightly deteriorated in quality | Good |
| Comparative Example 2 | 7.8 | 152 | 2.3 | 5.1 | 155 (X) | ○ | 79% | 19% (X) | Greatly deteriorated | Greatly deteriorated |
| Comparative Example 3 | 7.1 | 153 | 2.5 | 4.8 | 190 (○) | ○ | 51% | 5.2% (○) | Good | Slightly deteriorated in quality |

Example 5

An image was formed using the toner illustrated in Example 1 and a laser press 4161 (manufactured by Fuji Xerox Co., Ltd.) mounted with the non-magnetic one-component developing unit shown in FIG. 4.

The resulting image was fixed at a fixing temperature of 155° C. using a hard roll as the fixing roll to measure the glossiness of the fixed image. The glossiness of an image of a solid portion which contained 0.6 to 0.7 mg/cm of the toner adhered was measured in the condition that the measurement incident angle was 60°/60 °. As a result, every image of each color exhibited a glossiness as high as 20.

Also, no offset occurred even at 210° C. or more. An OHP image was also vivid and good.

It is intended to cover in the scope of the present invention such a modification and substitution with equivalent materials as will be made to the invention by a person skilled in the art.

What is claimed is:

1. A method for producing a toner comprising a colorant, comprising:

a step of dissolving or dispersing at least a binder resin, a colorant, and a releasing agent, in an organic solvent to prepare an oil-phase component; and a step of dispersing the oil-phase component in an aqueous medium to granulate the oil-phase component, wherein the binder resin contains a linear resin and a non-linear resin, and the releasing agent has an endothermic starting temperature of 40° C. or more and a melting point of 120° C. or less which are measured using a differential scanning calorimeter, the content of the releasing agent existing at the surface of toner particles is 1 to 10% of the total content of the releasing agent in each toner particle by weight; and the shape factor MLS2 of a toner particle of the toner which is represented by the following formula (I) is from 100 to 120 :

$$MLS2 = \frac{(\text{absolute maximum length of toner particle})^2}{(\text{projected area of toner particle})} \times \pi \times \frac{1}{4} \times 100. \quad \text{(I)}$$

2. A method for producing a toner according to claim 1, wherein the releasing agent is dispersed in the organic solvent in the step of preparing the oil phase component such that an average particle diameter of dispersion particles of said releasing agent is 3μm.

* * * * *